US010640323B2

(12) United States Patent
Deturk

(10) Patent No.: US 10,640,323 B2
(45) Date of Patent: May 5, 2020

(54) CREEL GUIDE

(71) Applicant: The LYCRA Company LLC, Wilmington, DE (US)

(72) Inventor: Charles P Deturk, Newark, DE (US)

(73) Assignee: The LYCRA Company LLC, Wilmington, DE (US)

( * ) Notice: Subject to any disclaimer, the term of this patent is extended or adjusted under 35 U.S.C. 154(b) by 17 days.

(21) Appl. No.: 15/735,452

(22) PCT Filed: Jun. 10, 2016

(86) PCT No.: PCT/US2016/036956
§ 371 (c)(1),
(2) Date: Dec. 11, 2017

(87) PCT Pub. No.: WO2016/201274
PCT Pub. Date: Dec. 15, 2016

(65) Prior Publication Data

US 2018/0170707 A1 Jun. 21, 2018

Related U.S. Application Data

(60) Provisional application No. 62/174,381, filed on Jun. 11, 2015.

(51) Int. Cl.
*B65H 57/14* (2006.01)
*B65H 57/26* (2006.01)
*B65H 57/16* (2006.01)

(52) U.S. Cl.
CPC ..... *B65H 57/14* (2013.01); *B65H 57/16* (2013.01); *B65H 57/26* (2013.01); *B65H 2701/31* (2013.01)

(58) Field of Classification Search
CPC ..... B65H 57/14; B65H 57/16; B65H 2701/31
See application file for complete search history.

(56) References Cited

U.S. PATENT DOCUMENTS 1,936,452 A 11/1933 Javery et al. ..... 242/155
3,871,621 A 3/1975 Jackson ..... 254/134.3
(Continued)

FOREIGN PATENT DOCUMENTS

DE 217927 12/2007
EP 0812793 12/1997
(Continued)

OTHER PUBLICATIONS

Extended European Search Report in EP 16808405.1 dated Jan. 23, 2019.

(Continued)

*Primary Examiner* — William E Dondero
(74) *Attorney, Agent, or Firm* — Bridget C. Sciamanna; Kathleen A. Tyrrell

(57) ABSTRACT

A rolling guide for a fiber strand comprises a first support member extending from a base of the roller guide to a compound joint having first and second portions. The first portion of the compound joint is mounted on the first support member for rotation around a first axis. The second portion of the compound joint being rotatable relative to the first portion around a second axis at a compound angle to the first axis. A second support member is connected with the second portion of the compound joint at a proximal end of the second support member. A channeled roller is carried on the second support member distally from the proximal end, and mounted for rotation around a third axis. The channeled roller has an annular channel formed therein. A fastener is provided to selectively prevent the second portion of the compound joint from rotating around the second axis relative to the first portion of the compound joint. Also provided according to the present disclosure is a method of guiding one or more fiber strands from a fiber package on a creel device to a destination location for further processing.

10 Claims, 4 Drawing Sheets

(56) References Cited

U.S. PATENT DOCUMENTS

| | | | | |
|---|---|---|---|---|
| 5,273,614 | A * | 12/1993 | Grimshaw | B29C 53/8016 156/425 |
| 5,564,637 | A | 10/1996 | Berthold et al. | |
| 6,554,540 | B1 | 4/2003 | Corsan | 405/184.4 |
| 6,676,054 | B2 | 1/2004 | Heaney et al. | |
| 8,936,223 | B1 * | 1/2015 | McGrath | F16C 11/103 248/205.1 |
| 2015/0014473 | A1 | 1/2015 | Maeda | |

FOREIGN PATENT DOCUMENTS

| | | | |
|---|---|---|---|
| EP | 1243347 | | 9/2002 |
| GB | 1442992 | | 7/1976 |
| JP | 9-14259 | A | 1/1997 |
| JP | 9-263357 | A | 10/1997 |
| JP | 2000-72330 | A | 3/2000 |
| WO | 2016/201274 | A1 | 12/2016 |

OTHER PUBLICATIONS

International Preliminary Report on Patentabiity Received for PCT Patent Application No. PCT/US2016/036956, dated Dec. 21, 2017, 7 pages.

International Search Report and Written Opinion received for PCT Patent Application No. PCT/US2016/036956, dated Sep. 23, 2016, 8 pages.

* cited by examiner

CREEL GUIDE

BACKGROUND

Field of the Disclosure

The present disclosure relates to textile manufacture. More specifically, the present disclosure is directed to method and system for guiding multiple thread ends from a creel to a textile manufacture machine while reducing friction, variations in tension, twist and scuffing.

Brief Discussion of Related Art

It is known in the textile manufacturing art, in which multiple strands of fiber are simultaneously fed to a manufacturing device, to provide an individual package and/or wound bobbin of such fibers as a source for each strand. One such textile product, as mere example and without limitation of the instant disclosure, is called a Machine Direction Stretch Nonwoven (MDXA). This fabric consists of a plurality of elastic fibbers arranged parallel with one another and under tension in an axial direction, that are laminated between layers of a non-woven polypropylene fiber by the application of adhesive and heat. With the laminate layers and bound together with one another and the intervening elastic fibers, the tension is released, and the laminate relaxes.

For efficiency in manufacturing these packages or bobbins are as large as practical, such as a 2 Kg package, so that the process may continue uninterrupted, and that in the aggregate, the time required to string or thread each fiber into the manufacturing device is minimized. The multiple packages of fiber are therefore positioned on a creel, one example of which is given by U.S. Pat. No. 6,676,054 to Heaney, et al., hereby incorporated by reference herein.

Moreover, for several types of textile products, the several strands are brought from their position and orientation on the creel, including various heights and axial takeoff directions, which is determined at least in part by the geometry of the creel, and these strands are brought together at or near parallel condition to facilitate their incorporation into the manufactured textile. In doing so, attempt must be made to minimize friction in the apparatus guiding each strand of fiber, in order to maintain a consistent fiber tension and also to avoid fiber breakage. This is particularly so in the case of elastomeric fibers, one example of which is sold by the assignee and applicant of the instant application under the LYCRA trademark.

Other considerations include minimizing scuffing of the exterior of the strand, which can adversely affect the strand-to-strand adhesion properties of certain fibers, including LYCRA® fiber. Scuffing can occur from abrasion of the fiber against static guides, or in the case of a free-rolling channel guide, scuffing can occur when the fiber is caused to bear, and thus rub against the side walls of the channel as it enters and/or exits the rolling guide.

The same forces that cause scuffing of the fiber strand can also cause twisting of the strand. Among the negative side-effects of twisting the fiber strand are variations in fiber tension, and deterioration of the structure of the fiber, which often is itself composed of filaments turned, braided and/or twisted around one another.

Friction also causes static buildup in the fiber strands, which in turn can cause strands to cling to or repel one another when this is not desired. This is particularly troublesome and difficult to avoid, for example in the MDXA fabric described above, among others, as the plural strands are converged adjacent to one another in a parallel condition in preparation for lamination.

The present state of the art is therefore wanting.

SUMMARY

Therefore, provided according to the present disclosure is a rolling guide for a fiber strand comprising a first support member extending from a base of the roller guide to a compound joint having first and second portions. The first portion of the compound joint is mounted on the first support member for rotation around a first axis. The second portion of the compound joint being rotatable relative to the first portion around a second axis at a compound angle to the first axis. A second support member is connected with the second portion of the compound joint at a proximal end of the second support member.

A channeled roller is carried on the second support member distally from the proximal end, and mounted for rotation around a third axis. The channeled roller has an annular channel formed therein. A fastener is provided to selectively prevent the second portion of the compound joint from rotating relative to the first portion of the compound joint.

In a further embodiment of the present disclosure, the first support member is operative to adjust the distance between the base of the roller guide and the compound joint. In yet another embodiment of the present disclosure, the position of the channeled roller is adjustable on the second support member relative to the second portion of the compound joint. According to a further embodiment of the present disclosure, the fastener—locking device—using a hex nut—is further operative to selectively prevent the first portion of the compound joint from rotating around the first axis.

In a further embodiment of the present disclosure, the first portion of the compound joint comprises a first facing surface, and the second portion of the compound joint has a second facing surface, the first and second facing surfaces opposing one another. At least one of the first or second facing surfaces is provided with at least one of a fiction-enhancing material, a friction-enhancing surface treatment, and a combination thereof. Alternately or additionally, at least one of the first or second facing surfaces is provided with one or more spaced, complementary, and interlocking surface features arranged radially around the second axis.

In still a further embodiment of the present disclosure, the channeled roller comprises a plurality of channeled rollers, each channeled roller of the plurality mounted for rotation around the second axis independently of any other channeled roller in the plurality of channeled rollers, and each channeled roller of the plurality having an annular channel formed therein.

Also provided according to the present disclosure, is a method of guiding a fiber strand from a fiber package on a creel device to a destination location for further processing. The disclosed method includes providing a roller guide as described according to the one or more above embodiments. The fiber strand is placed in the annular channel of the channeled roller to turn the fiber strand from a first direction vector between the fiber package and the roller guide, to a second direction vector between the roller guide and the destination location. The channeled roller of the roller guide is oriented to place the fiber strand in a first plane defined by a bottom of the annular channel therein, the first plane containing both the first and second direction vectors, wherein the fiber strand is tangent and perpendicular (on average)—only the center package yarns will be perpendicular—because the packages are not parallel to the annular channel. The fastener is secured to hold the orientation of the channeled roller.

In still a further embodiment of the present disclosure, a method of guiding a plurality of fiber strands from respective origin locations on a creel device to respective destination locations for further processing comprises providing a roller guide according to the one or more above embodiments including a plurality of channeled rollers. Each of the plurality of fiber strands is placed in a respective annular channel of the plurality of channeled rollers to turn the fiber strands from a first direction vector between the respective origin location and the roller guide, to a second direction vector between the roller guide and the respective destination locations. No fiber strand crosses any other fiber strand. The roller guide is oriented to minimize a deviation of each fiber strand in the plurality from a respective plane defined by a bottom of its respective annular channel between the origin location and the channeled roller, and between the channeled roller and the destination location, wherein the fiber strand is tangent and perpendicular (on average) to the annular channel. The fastener is secured to hold the orientation of the channeled roller.

These and other purposes, goals and advantages of the present disclosure will become apparent from the following detailed description of example embodiments read in connection with the accompanying drawings.

BRIEF DESCRIPTION OF THE DRAWINGS

Some embodiments are illustrated by way of example and not limitation in the figure of the accompanying drawings, with like reference numerals referring to like structures across the several views, and wherein.

DETAILED DESCRIPTION

Figure 1:
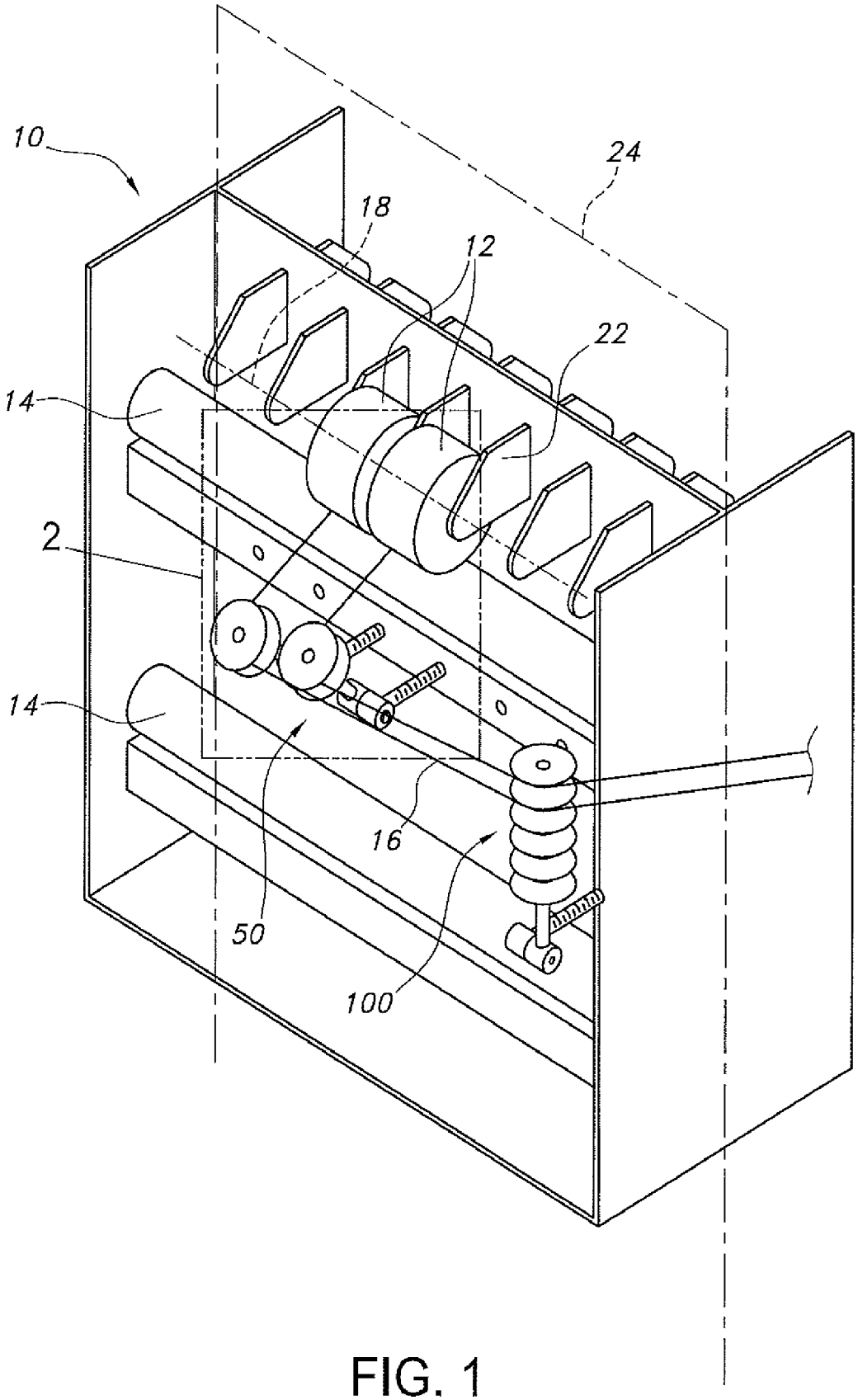
FIG. 1 depicts, schematically, a creel having creel guides according to an embodiment of the present disclosure.

Referring now to FIG. 1, illustrated is a creel, generally 10. Several packages 12 of wound fiber may be situated on rollers 14 of the creel 10. The packages consist of a quantity of the fiber strand 16 wound around an axis 18 of the package, in some cases including a coaxial core (not shown), typically a tube core, which gives initial structure of the package as it is being previously formed. The package is oriented such that by driving a pair of rollers 14, the package 12 is turned around its axis 18, and the fiber strand is thus unwound from the package. FIG. 1 depicts fewer than all packages 12 that can be accommodated by the creel 10, solely for clarity of illustration. The number of packages 12 can vary depending on the number designed for in the creel. In practice, multiple packages 12 are situated on a pair rollers 14, with the packages 12 on a given set of rollers resting between one or more dividers 22 separating one package 12 from an adjacent package. Each package 12 provides its own strand 16 via roller guide 50.

As the driven set rollers 14 turn, the packages 12 rotate and the fiber strand 16 is drawn off of the package 12. The rate of takeoff from the package 12 is controlled by the speed of the driven roller 14, independent of the diameter of the package 12, which will gradually and systematically reduce as the fiber strand 16 is unwound from the package 12. In the case of FIG. 1, as example only, fiber strands 16 are taken off the package 12 in an outward direction from a medial plane 24 of the creel 10. Other creel geometries present different specific orientations. However, the challenge remains to guide each fiber strand 16 from the location of its respective package 12 on the creel 10, to a position and orientation with respect to adjacent fiber strands 16 for their inclusion in a manufactured textile product, without damaging the fiber strand 16.

Figure 2:
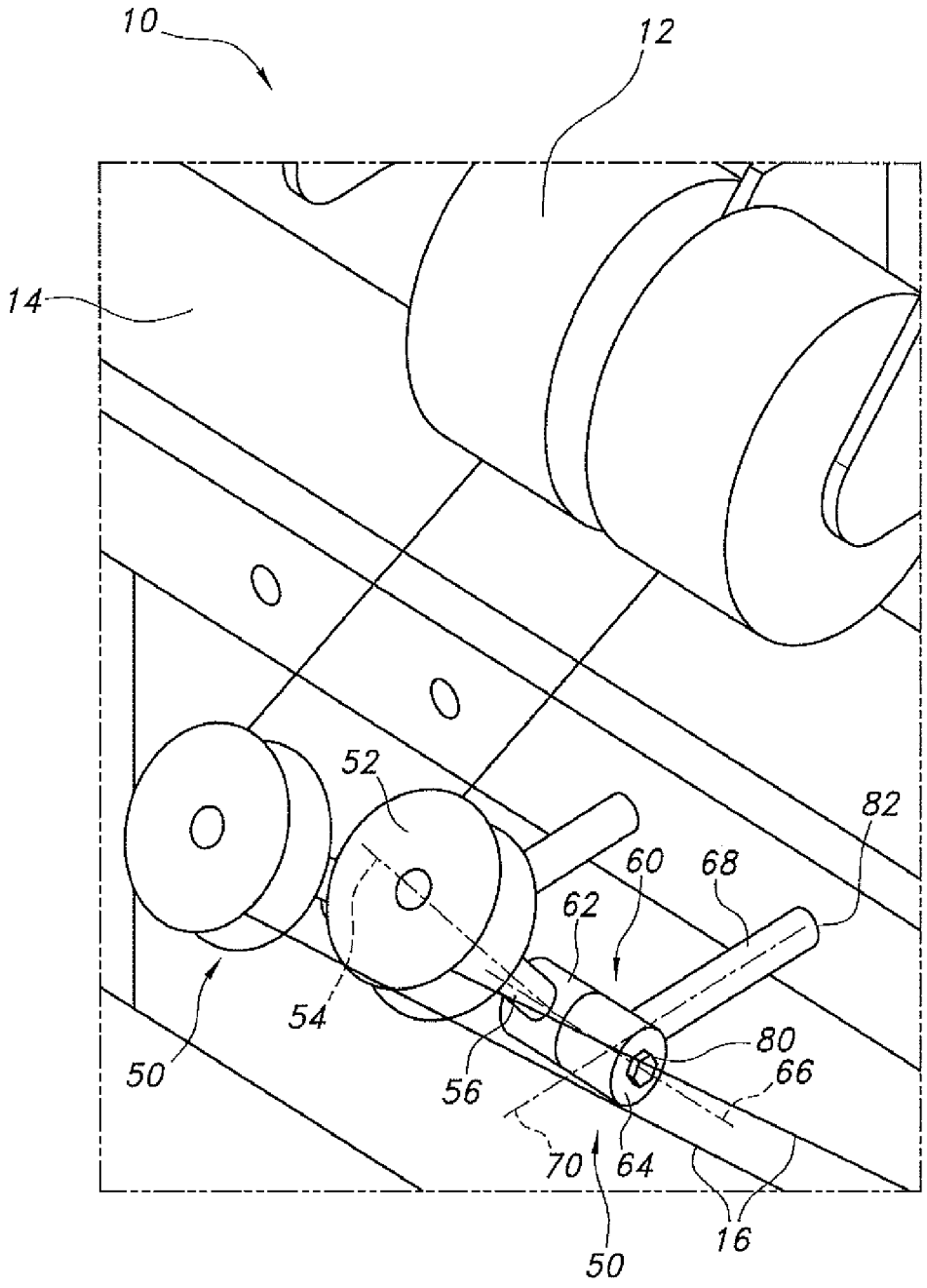
FIG. 2 illustrates a roller guide according to an embodiment of the present disclosure.

Referring now to FIG. 2, illustrated is a roller guide, generally 50, according to a first embodiment of the present disclosure. Like FIG. 1, FIG. 2 depicts fewer than all packages 12 that can be accommodated by the creel 10, for clarity of illustration. The roller guide 50 includes a channeled roller 52, mounted for rotation around a central axis 54, which in the exemplary embodiment is coincident with a support rod 56. The channeled roller 52 may include a bearing device (not shown) to facilitate its free rotation around the axis 54. The support rod 56 in turn is connected with a compound joint 60, which is formed of first and second halves 62 and 64. The support rod 56 is connected with the first half 62. The first half 62 is able to rotate around an intermediate axis 66 with respect to the second half 64. The second half 64 is in turn connected with a mounting rod 68 such that the second half is operable to rotate around a third axis 70 coincident with the longitudinal axis of the mounting rod 68. The mounting rod 68 is in turn secured to the creel 10, which forms a base 82 for the roller guide 50.

Figure 2A:
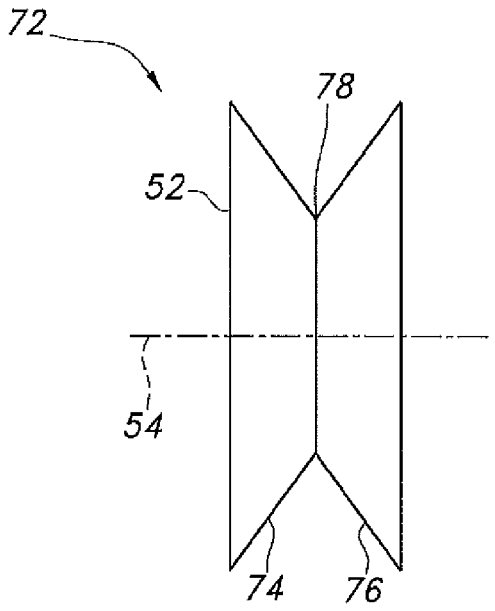
FIG. 2A illustrates in a profile view of the channeled roller according to an embodiment of the present disclosure.

Referring now to FIG. 2A, illustrated in a profile view of the channeled roller 52. The channeled roller 52 includes a generally V-shaped channel 72 therein, in which opposing channel walls 74, 76 converge at an apex 78 in the bottom the channel 72, which may optionally be flattened or rounded. The fiber strand 16 is arranged to enter the channel 72 and bear against the apex 78 of the channel, and be wrapped some predetermined angle around the central axis 54. For the avoidance of scuffing, twisting, friction, etc., being applied to the fiber strand 16 by the roller guide 50 as the fiber strand 16 passes through the channeled roller 52, it is desirable that the fiber strand 16 both enter and exit the roller guide 50 aligned in the plane defined by the apex 78 of the channel 72, and both enter and exit the channeled roller 52 tangent to an arc described by the apex 78 and perpendicular to 54.

Optionally, in certain embodiments, the mounting rod may be adjustable in length, for example where the mounting rod 68 is threaded and its mounting point on the creel 10 is compatibly threaded, such that the roller guide 50 may be made nearer or father from the creel 10 without altering the plane of the channeled roller 52. Optionally, though not shown in the present embodiment, the support rod 56 may be made adjustable in length as well, and/or the position of the channeled roller on the support rod 56 may be made to adjust.

Figure 2B:
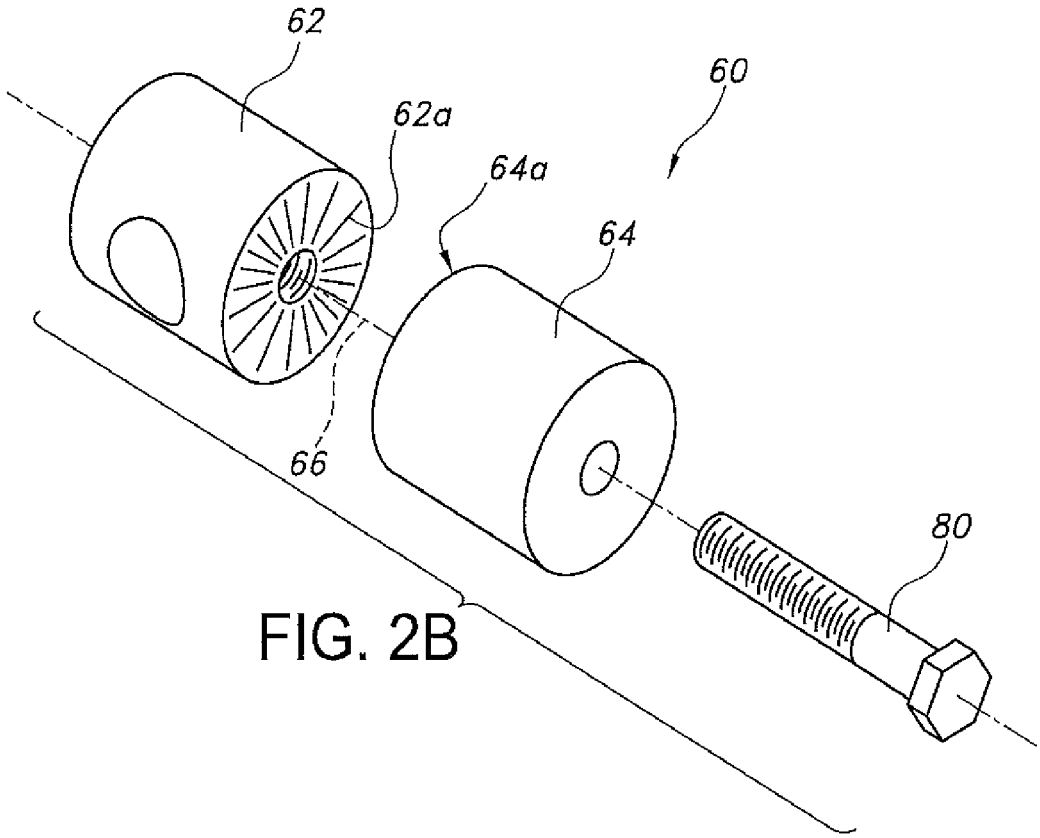
FIG. 2B illustrates an exploded assembly view of the compound joint of the roller guide according to an embodiment of the present disclosure.

Referring now to FIG. 2B, illustrated is an exploded assembly view of the compound joint 60. In certain embodiments of the present disclosure, the first and second halves 62, 64 may optionally include a friction enhancement on their respective facing surfaces 62*a*, 64*a*. For example, an application of material to and/or surface treatment of facing surfaces 62*a*, 64*a* can serve to increase roughness and thereby enhance friction between the two halves 62, 64. Thus, the halves 62, 64 are less likely to be inadvertently moved once set in a desired position.

The halves 62, 64 can be drawn together to hold their position relative to one another, for example by a fastener 80 aligned with the second axis 66. A threaded fastener, washer, and or threaded nut may be used, as will be understood to those of skill in the art. Tightening the fastener 80, optionally including a washer and/or threaded nut, alternately an internal thread provided on one of the halves 62, 64, secures the halves 62, 64 against one another and thus constrains the position of the channeled roller 52. Optionally, tightening of the fastener 80 may also serve to secure the rotation of the compound joint 60 around mounting rod 68, for example by pressing the second half 64 against the mounting rod 68, thus further constraining the position of the roller guide 50. Accordingly, the compound joint 60 permits the support rod 56 and is central axis 54 to be rotated both in a compound azimuth and elevation with respect to the third axis 70, which is in the present example coincident with the mounting rod 68.

In the configuration described above and illustrated in FIG. 2, the roller guide 50 is operative to guide a fiber strand 16 taken off from a package 12 around roller 14. As shown in the FIG. 2, the fiber strand 16 is turned some angle around the roller 14, so that the fiber strand 16 is known to be in a plane defined by the circumference of the roller 14. The fiber strand 16 is then turned through the apex 78 of the channel 72, and exits the channeled roller 52 directed in a direction of one end of the creel 10, and towards a downstream process including the fiber strand 16.

Figure 3:
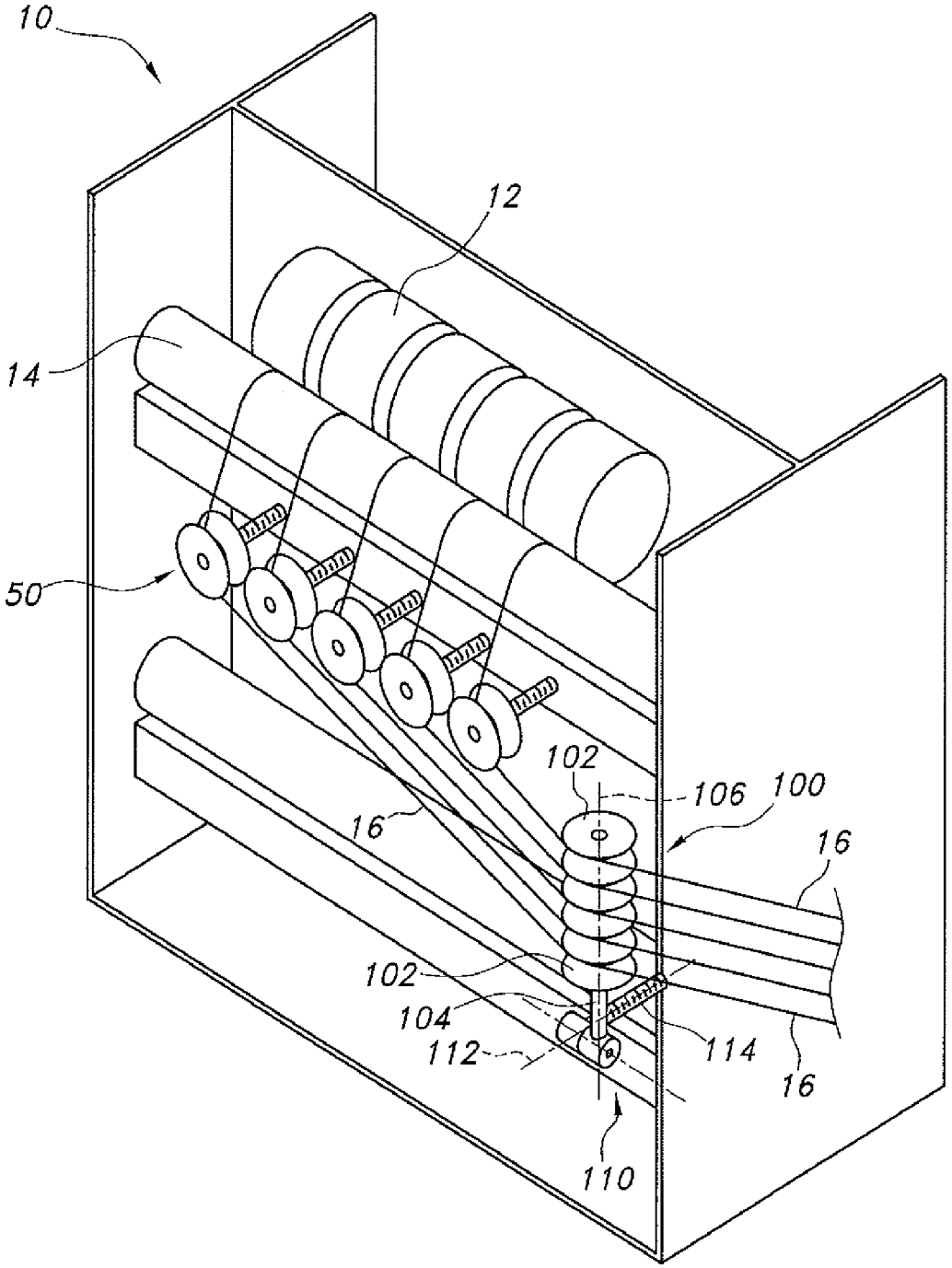
FIG. 3 illustrates a roller guide according to another embodiment of the present disclosure.

Referring now to FIG. 3, illustrated is a second embodiment of a roller guide, generally 100. Certain features of the roller guide 100 will be readily apparent to those of skill in the art having read the instant disclosure above, and therefore a complete recitation of the features will be dispensed with as redundant. The salient differences between roller guide 100 and roller guide 50 will be discussed. Like FIGS. 1 and 2, FIG. 3 depicts fewer than all packages 12 that can be accommodated by the creel 10.

Roller guide 100 combines plural channeled rollers 102 coaxially aligned on a common support rod 104. Each channeled roller 102 is free to rotate independently of any adjacent channeled rollers 102, and each may be provided with an independent bearing (not shown) for that purpose. The roller guide 100 includes a compound joint 110 that permits the central axis 106 to be rotated both in a compound azimuth and elevation with respect to a third axis 112 of a mounting rod 114.

In the embodiment depicted in FIG. 3, five (5) channeled rollers 102 are depicted mounted together on a single roller guide 100. Those of skill in the art will recognize that the number of channeled rollers included in the roller guide may vary depending on the number of fiber ends, number of packages of yarn and desired denier of the yarn strands. This may include 4 to 20 channeled rollers per roller guide, 5 to 10 channeled rollers, or 5 to 6 channeled rollers. Each roller has independent bearings and rolls independently of the other channeled rollers 102 More or fewer channeled rollers 102 may be provided without departing from the scope of the instant disclosure. In one embodiment, the creel 10 was equipped with rollers 14 providing space for twelve (12) packages 12 of fiber thread 16. Grouping six channeled rollers 102 together allows for two roller guides 100 per roller 14. One of skill in the art acquainted with the instant disclosure may find it convenient to provide three roller guides 100 having four (4) channeled rollers 102 on each roller guide 100, or virtually any other combination of equal or unequal numbers as will seem convenient to the artisan.

It remains the case that to avoid scuffing, twisting, and/or friction or other deleterious effects on the fiber strand 16 by the channeled roller 102, it is desirable to have the fiber strand 16 both enter and exit the channeled roller 102 aligned in the plane defined by the apex of the channel, and both enter and exit the channeled roller 102 tangent to that apex and perpendicular to 54. In the case of plural channeled rollers 102 in a single roller guide 100, the plural fiber strands 16 will likely approach the roller guide 100 from divergent positions such that the fiber strands 16 are not in respective parallel planes defined by each of the channeled rollers 102. The same may be true for the destination of the fiber strands 16 upon leaving the channeled rollers 102, that they are divergent and thus not aligned in respective parallel planes.

To address this problem of convergence and divergence of the fiber strands 16 at the roller guide 100, according to the instant disclosure, at the outset it will be advantageous to select those fiber strands 16 having origin and destination with respect to the roller guide 100 as nearly aligned in respective parallel planes, as defined by the bodies of the respective channeled rollers 102, as is feasible. Moreover, the ability to adjust the alignment of the central axis 106 with respect to both the azimuth and elevation with respect to the third axis 112 of a mounting rod 114, permits the orientation of the roller guide 100 that is the best compromise for all fiber strands 16 passing through the given roller guide 100. Often it is the case that fiber strands converge leading to the roller guide 100, and then diverge proceeding away from it, in a way that none of the fiber strands 16 crosses one another. In that ease, setting the roller guide to be in a plane defined by the approach and exit of the centermost fiber strand 16, or in the case of an even number of channeled rollers 102, a mean of the two centermost fiber strands 16, approximates the minimum divergence from the preferred parallel plane orientation described, and thus the minimum stress upon the fiber strands 16. In further cases where the fiber strands 16 do not converge and/or diverge in an equally distributed manner, it is possible to select an orientation of the roller guide 100 that deviates from the parallel plane condition of all fiber strands 16 to the least extent possible when considering the aggregate cumulative deviation of all affected fiber strands 16 passing over the roller guide 100. The deviation from a perfect parallel strands convergence and divergence can be addressed or decreased by reducing the number of strands to a quantity less than 6.

The foregoing description indicates roller guides 50, 100, that are each attached to the creel 10 itself. It is noted, however, that the alternately or additionally, guide rollers of either type may be advantageously positioned in a position displaced from the body of the creel 10, to further refine the position and/or angle of approach of the fiber strands 16 to the textile manufacturing process.

It is noted that in certain applications, multiple fiber threads 16 are strung together through a single roller to channeled roller 102 of the roller guide 100, in order to advantageously alter the characteristics of the manufactured textile product. Adding more than one ends increases the denier of the yarn. In this case, the plural fiber strands 16 necessarily converge upon a single channeled roller 52, 102, but would move away from the roller guide 50, 100 as a unit strand. In this embodiment, similarly as described above, it will not be possible that two fiber strands 16 approach the same channeled roller 52, 102 in the plane defined by the channeled roller 52, 102. Therefore, to minimize scuffing, twisting, or the like, initially the originating position of the two fiber strands 16 which converge upon the same channeled roller 52, 102, will be selected as near as possible to being within the same plane. Additionally, the position and orientation of the of the roller guide 50, 100 will be set to an orientation that deviates from the parallel plane condition of the plural fiber strands 16 with respect to the channeled rollers 52, 102, to the least extent possible, considering the aggregate and/or cumulative deviation of all affected fiber strands 16 passing over the roller guide 50, 100.

Variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A rolling guide for a fiber strand comprising:

a first support member extending from a base of the roller guide to a compound joint having first and second portions, the first portion of the compound joint being mounted on the first support member for rotation around a first axis;

the second portion of the compound joint being rotatable relative to the first portion around a second axis at a compound angle to the first axis;

a second support member connected with the second portion of the compound joint at a proximal end of the second support member;

a channeled roller carried on the second support member distally from the proximal end, and mounted for rotation around a third axis, the channeled roller having an annular channel formed therein; and a fastener positioned to selectively prevent the first portion of the compound joint from rotating around the first axis and the second portion of the compound joint from rotating around the second axis relative to the first portion of the compound joint.

2. A rolling guide for a fiber strand according to claim 1, wherein the first support member is operative to adjust the distance between the base of the roller guide and the compound joint.

3. A rolling guide for a fiber strand according to claim 1, wherein the position of the channeled roller is adjustable on the second support member relative to the second portion of the compound joint.

4. A rolling guide for a fiber strand according to claim 1, wherein the first portion of the compound joint comprises a first facing surface, and the second portion of the compound joint has a second facing surface, the first and second facing surfaces opposing one another, at least one of the first or second facing surfaces is provided with one or more spaced, complementary, and interlocking surface features arranged radially around the second axis.

5. A rolling guide for a fiber strand according to claim 1, wherein the channeled roller comprises a plurality of channeled rollers, each channeled roller of the plurality mounted for rotation around the third axis independently of any other channeled roller in the plurality of channeled rollers, and each channeled roller of the plurality having an annular channel formed therein.

6. A method of guiding a fiber strand from a fiber package on a creel device to a destination location for further processing, the method comprising:

providing a roller guide according to claim 1;

placing the fiber strand in the annular channel of the channeled roller to turn the fiber strand from a first direction vector between the fiber package and the roller guide, to a second direction vector between the roller guide and the destination location;

orienting the channeled roller of the roller guide to place the fiber strand in a first plane defined by a bottom of the annular channel therein, the first plane containing both the first and second direction vectors, wherein the fiber strand is tangent to the annular channel; and securing the fastener to hold the orientation of the channeled roller.

7. A method of guiding a fiber strand according to claim 6, further comprising holding the fiber strand under tension.

8. A method of guiding a plurality of fiber strands from respective origin locations on a creel device to respective destination locations for further processing, the method comprising:

providing a roller guide according to claim 6;

placing each of the plurality of fiber strands in a respective annular channel of the plurality of channeled rollers to turn the fiber strands from a first direction vector between the respective origin location and the roller guide, to a second direction vector between the roller guide and the respective destination locations, wherein no fiber strand crosses any other fiber strand;

orienting the roller guide to minimize a deviation of each fiber strand in the plurality from a respective plane defined by a bottom of its respective annular channel between the origin location and the channeled roller, and between the channeled roller and the destination location, wherein the fiber strand is tangent to the annular channel; and securing the fastener to hold the orientation of the channeled roller.

9. A method of guiding a plurality of fiber strands according to claim 8, wherein more than one fiber strand share a channeled roller.

10. A method of guiding a plurality of fiber strands according to claim 8, further comprising holding the fiber strand under tension.

* * * * *